US010810972B2

(12) United States Patent
Igarashi et al.

(10) Patent No.: US 10,810,972 B2
(45) Date of Patent: Oct. 20, 2020

(54) IMAGE PROCESSOR THAT OUTPUTS ON-SCREEN-DISPLAY INFORMATION

(71) Applicant: SEIKO EPSON CORPORATION, Tokyo (JP)

(72) Inventors: Mitsuhiko Igarashi, Matsumoto (JP); Nobuyuki Shimizu, Matsumoto (JP); Yasushi Maruyama, Matsumoto (JP); Takehiko Tone, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/261,949

(22) Filed: Jan. 30, 2019

(65) Prior Publication Data

US 2019/0237046 A1 Aug. 1, 2019

(30) Foreign Application Priority Data

Jan. 31, 2018 (JP) ..... 2018-015691

(51) Int. Cl.
*G09G 5/377* (2006.01)

(52) U.S. Cl.
CPC ..... *G09G 5/377* (2013.01); *G09G 2340/02* (2013.01); *G09G 2340/12* (2013.01); *G09G 2360/12* (2013.01)

(58) Field of Classification Search
CPC ..... G09G 3/001; G09G 5/14; G09G 5/377; G09G 5/393; G09G 5/395; G09G 5/399; G09G 9/7921; G09G 9/8205; G09G 9/8227; G09G 2340/04; G09G 2340/12; G09G 2340/0407; G09G 2360/12; G09G 2340/02; G06F 3/0482; G06F 13/4282; G06T 3/4084; H04N 5/4401; H04N 5/44504; H04N 13/156; H04N 13/189; H04N 13/183; H04N 21/42204; H04N 21/42653; H04N 21/4316
See application file for complete search history.

(56) References Cited

U.S. PATENT DOCUMENTS

2010/0225827 A1* 9/2010 Lee ..... H04N 5/44543 348/726
2015/0130899 A1* 5/2015 Koizumi ..... H04N 21/4884 348/43

FOREIGN PATENT DOCUMENTS

CN 1496114 A * 5/2004 ..... H04N 21/4316
JP 2015-141365 A 8/2015

* cited by examiner

*Primary Examiner* — Maurice L. McDowell, Jr.
*Assistant Examiner* — Donna J. Ricks
(74) *Attorney, Agent, or Firm* — Oliff PLC

(57) ABSTRACT

An image processing apparatus includes a first image processing circuit and a second image processing circuit connected to the first image processing circuit via a first signal line and a second signal line. The first image processing circuit outputs OSD image data representing an OSD image in the form of n sets of divided OSD image data that are generated by dividing the OSD image data by n to the second image processing circuit via the first signal line and outputs position information of the divided OSD image data to the second image processing circuit via the second signal line. The second image processing circuit outputs, based on first input image data, the n sets of divided OSD image data, and the position information, combined image data representing a combined image formed of the first input image on which the OSD image is superimposed.

18 Claims, 7 Drawing Sheets

IMAGE PROCESSOR THAT OUTPUTS ON-SCREEN-DISPLAY INFORMATION

CROSS-REFERENCE

The entire disclosure of Japanese Patent Application No. 2018-015691, filed Jan. 31, 2018 is expressly incorporated by reference herein.

BACKGROUND

1. Technical Field

The present invention relates to a technology for processing image information.

2. Related Art

JP-A-2015-141365 describes a projector having the function of generating combined image data representing a combined image formed of an input image on which an on-screen-display (OSD) image is superimposed (hereinafter also referred to as "OSD function").

It is conceivable to achieve the OSD function by using two image processing circuits (the two image processing circuits are hereinafter referred to as a "first image processing circuit" and a "second image processing circuit"). For example, the first image processing circuit reads OSD image data representing an OSD image from a memory and transmits the OSD image data to the second image processing circuit. The second image processing circuit uses the OSD image data received from the first image processing circuit and input image data representing an input image to output combined image data representing a combined image.

In the configuration described above, however, it takes time to output the combined image data because it takes time to transmit the OSD image data from the first image processing circuit to the second image processing circuit.

SUMMARY

An advantage of some aspects of the invention is to provide a technology for shortening the period required to output combined image data in a case where two image processing circuits are used to achieve the OSD function.

An aspect of an image processing apparatus according to the invention includes a first image processing circuit and a second image processing circuit connected to the first image processing circuit via a first signal line and a second signal line. The first image processing circuit outputs OSD image data representing an OSD image in a form of n sets of divided OSD image data that are generated by dividing the OSD image data by n to the second image processing circuit via the first signal line and outputs position information representing positions of the divided OSD image data to the second image processing circuit via the second signal line. The second image processing circuit outputs, based on first input image data representing a first input image, the n sets of divided OSD image data, and the position information, combined image data representing a combined image formed of the first input image on which the OSD image is superimposed.

According to the aspect described above, when OSD image data is provided, divided OSD image data having resolution lower than that of the OSD image data are outputted from the first image processing circuit to the second image processing circuit. The period required to transmit data according to the OSD image from the first image processing circuit to the second image processing circuit can therefore be shortened as compared, for example, with a configuration in which the OSD image data is outputted from the first image processing circuit to the second image processing circuit. Therefore, according to the aspect described above, the period required to output combined image data can be shortened.

In the aspect of the image processing apparatus described above, it is desirable that the first image processing circuit includes a dividing section that divides the OSD image data by n to generate the n sets of divided OSD image data.

According to the aspect described above, divided OSD image data can be generated from the OSD image data.

In the aspect of the image processing apparatus described above, it is desirable that the first image processing circuit outputs the divided OSD image data to the second image processing circuit via the first signal line when an action mode is a first mode and outputs second input image data representing a second input image to the second image processing circuit via the first signal line when the action mode is a second mode, and that the second image processing circuit outputs the combined image data based on the first input image data, the n sets of divided OSD image data, and the position information when the action mode is the first mode and converts resolution of the second input image data and outputs the resultant second input image data as output image data when the action mode is the second mode.

According to the aspect described above, switching the action mode from one to the other, the function of outputting the combined image data and the function of outputting the output image data can be alternatively performed.

In the aspect of the image processing apparatus described above, it is desirable that the first image processing circuit outputs action mode information representing the action mode to the second image processing circuit via the second signal line, and that the second image processing circuit determines the action mode based on the action mode information.

According to the aspect described above, the second signal line used to transmit the position information to the second image processing circuit can also be used as a signal line for transmitting the action mode information to the second image processing circuit. Therefore, for example, the configuration of the image processing apparatus can be simplified as compared with a configuration in which the signal line for transmitting the action mode information to the second image processing circuit is a dedicated line.

In the aspect of the image processing apparatus described above, it is desirable that the second image processing circuit includes a frame memory, that the position information represents the positions of the divided OSD image data in the frame memory, and that the second image processing circuit writes the divided OSD image data based on the position information onto the frame memory to generate the OSD image data.

According to the aspect described above, the second image processing circuit can restore the OSD image data by using the position information and the divided OSD image data.

In the aspect of the image processing apparatus described above, it is desirable that the second image processing circuit outputs the combined image data in accordance with an instruction from the first image processing circuit.

According to the aspect described above, the first image processing circuit can control the second image processing circuit to cause it to output the combined image data.

In the aspect of the image processing apparatus described above, it is desirable that in a case where resolution of the OSD image data is higher than or equal to a threshold, the first image processing circuit outputs the divided OSD image data to the second image processing circuit.

According to the aspect described above, the divided OSD image data can be transmitted, for example, only in a case where it takes time to transmit the OSD image data from the first image processing circuit to the second image processing circuit because the OSD image data has resolution higher than or equal to the threshold.

In the aspect of the image processing apparatus described above, it is desirable that in a case where the resolution of the OSD image data is lower than the threshold, the first image processing circuit compresses the OSD image data to generate compressed OSD image data and outputs the compressed OSD image data to the second image processing circuit via a third signal line, and that the second image processing circuit decompresses the compressed OSD image data to generate decompressed OSD image data and outputs the combined image data based on the decompressed OSD image data and the input image data.

According to the aspect described above, in the case where the resolution of the OSD image data is lower than the threshold, the compressed OSD image data, which is the OSD image data having been compressed, is outputted from the first image processing circuit to the second image processing circuit. The period required to transmit data according to the OSD image data from the first image processing circuit to the second image processing circuit can be shortened as compared with a configuration in which the OSD image data is not compressed but is outputted as it is from the first image processing circuit to the second image processing circuit. Therefore, according to the aspect described above, the period required to output the combined image data can be shortened.

In the aspect of the image processing apparatus described above, it is desirable that in a case where the resolution of the OSD image data is lower than the threshold and the OSD image data satisfies a compression condition set in advance, the first image processing circuit generates the compressed OSD image data and outputs the compressed OSD image data to the second image processing circuit via the third signal line.

According to the aspect described above, in the case where the resolution of OSD image data is lower than the threshold and the OSD image data satisfies the compression condition set in advance, the compressed OSD image data can be outputted from the first image processing circuit to the second image processing circuit. In this case, setting the compression condition as appropriate allows, for example, compression only of compression-effective OSD image data and can prevent ineffective compression.

An aspect of a display apparatus according to the invention includes the image processing apparatus described above and a display section that displays an image according to the combined image data outputted by the image processing apparatus on a display surface.

According to the aspect described above, the period required to output the combined image data can be shortened, whereby the period required to display an image according to the combined image data can be shortened.

An aspect of image processing method according to the invention includes causing a first image processing circuit to output OSD image data representing an OSD image in a form of n sets of divided OSD image data that are generated by dividing the OSD image data by n to a second image processing circuit via a first signal line and output position information representing positions of the divided OSD image data to the second image processing circuit via a second signal line and causing the second image processing circuit to output, based on input image data representing an input image, the n sets of divided OSD image data, and the position information, combined image data representing a combined image formed of the input image on which the OSD image is superimposed.

According to the aspect described above, when OSD image data is provided, divided OSD image data having resolution lower than that of the OSD image data are outputted from the first image processing circuit to the second image processing circuit. The period required to transmit data according to the OSD image from the first image processing circuit to the second image processing circuit can therefore be shortened as compared with a configuration in which the OSD image data is outputted from the first image processing circuit to the second image processing circuit. Therefore, according to the aspect described above, the period required to output combined image data can be shortened.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
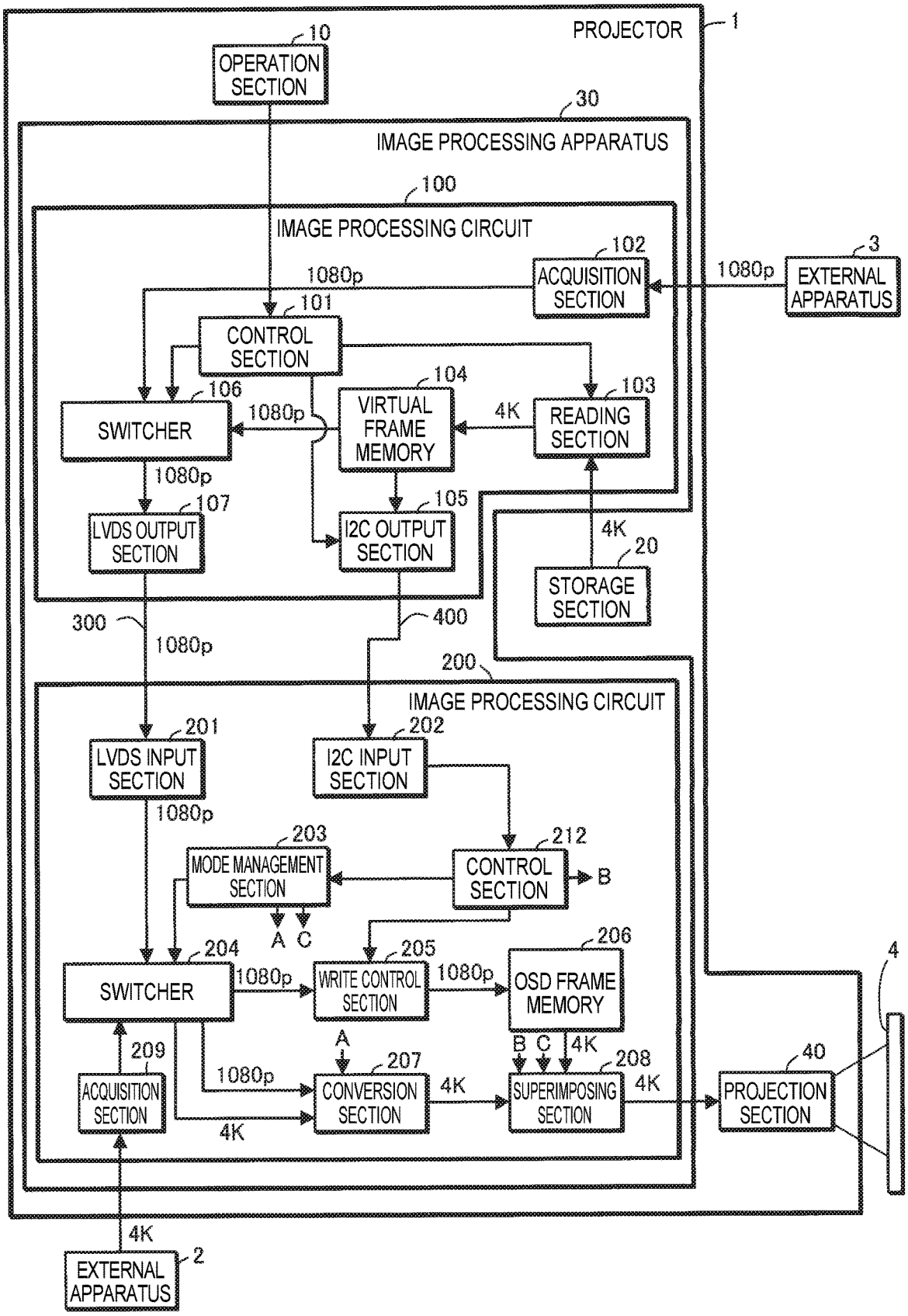
FIG. 1 shows a projector according to a first embodiment.

Embodiments according to the invention will be described below with reference to the drawings. In the drawings, the dimension and scale of each portion differ from actual values as appropriate. Further, since the embodiments described below are preferable specific examples of the invention, a variety of technically preferable restrictions are imposed on the embodiments. The scope of the invention is, however, not limited to the embodiments unless the following description particularly states that the restrictions are imposed on the invention.

First Embodiment

FIG. 1 shows a projector 1 according to a first embodiment. The projector 1 is an example of a display apparatus.

The projector 1 includes an operation section 10, a storage section 20, an image processing section 30, and a projection section 40.

The operation section 10 is formed, for example, of a variety of operation buttons or operation keys or a touch panel. The operation section 10 accepts a user's input operation. The operation section 10 may, for example, be a remote control that transmits information according to the user's input operation wirelessly or via a cable. In this case, the projector 1 includes a receiver that receives the information transmitted by the remote control. The remote control includes a variety of operation buttons or operation keys or a touch panel that accepts the user's input operation.

The storage section 20 stores OSD image data representing an OSD image. The OSD image data has a resolution of 3840×2160 pixels (hereinafter also referred to as "4K"). An OSD image represents, for example, a menu screen. An OSD image is not limited to a menu screen and can be changed as appropriate.

The image processing apparatus 30 acquires first input image data representing a first input image from an external apparatus 2, such as a personal computer (PC). The first input image data has a resolution of 4K.

The image processing apparatus 30 acquires second input image data representing a second input image from an external apparatus 3, such as a PC. The second input image data has a resolution of 1920×1080 pixels (hereinafter also referred to as "1080p").

The image processing apparatus 30 has an OSD mode and an input image mode as the action mode thereof. The OSD mode is an example of a first mode. The input image mode is an example of a second mode.

The image processing apparatus 30 uses the 4K OSD image data stored by the storage section 20 and 4K first input image data acquired from the external apparatus 2 to output combined image data representing a combined image formed of the first input image on which the OSD image is superimposed. The combined image data has the resolution of 4K.

In the input image mode, the image processing apparatus 30 performs scaling operation of converting the resolution of the 1080p second input image data acquired from the external apparatus 3 to generate output image data representing the second input image. The output image data has the resolution of 4K.

The image processing apparatus 30 includes image processing circuits 100 and 200 and signal lines 300 and 400. The image processing circuit 100 is an example of a first image processing circuit. The image processing circuit 100 functions as a master circuit. The image processing circuit 200 is an example of a second image processing circuit. The image processing circuit 200 functions as a slave circuit. The image processing circuit 200 is connected to the image processing circuit 100 via the signal lines 300 and 400. The signal line 300 is an example of a first signal line. The signal line 400 is an example of a second signal line.

In the OSD mode, the image processing circuits 100 and 200 operate as follows.

The image processing circuit 100 divides the 4K OSD image data by four to generate four sets of divided OSD image data. The divided OSD image data each have the resolution of 1080p. The image processing circuit 100 outputs the four sets of divided OSD image data to the image processing circuit 200 via the signal line 300. The image processing circuit 100 further outputs position information representing the positions of the divided OSD image data via the signal line 400. The position information on the positions of the divided OSD image data may be outputted within the period for which the divided OSD image data are outputted or may be outputted before the divided OSD image data are outputted.

The image processing circuit 200 generates combined image data based on the 4K first input image data acquired from the external apparatus 2, the four sets of divided OSD image data received via the signal line 300, and the position information received via the signal line 400.

In the input image mode, the image processing circuits 100 and 200 operate as follows.

The image processing circuit 100 outputs the 1080p second input image data acquired from the external apparatus 3 to the image processing circuit 200 via the signal line 300.

The image processing circuit 200 performs scaling operation on the second input image data received via the signal line 300 to produce output image data.

The image processing circuit 100 will next be described.

The image processing circuit 100 includes a control section 101, an acquisition section 102, a reading section 103, a virtual frame memory 104, an inter-integrated circuit (I2C) output section 105, a switcher 106, and a low voltage differential signaling (LVDS) output section 107.

The control section 101 performs a variety of types of control in accordance with the user's input operated performed on the operation section 10. For example, the control section 101 switches the action mode from one to the other in accordance with the user's input operation. The control section 101 notifies the reading section 103, the I2C output section 105, and the switcher 106 of action mode information representing the action mode. The control section 101, when it switches the action mode to the OSD mode, outputs a blackout start instruction that causes the projection section 40 to project a black image to the I2C output section 105.

The acquisition section 102 acquires 1080p second input image data from the external apparatus 3.

When the action mode information indicates that the action mode is the OSD mode, the reading section 103 reads the 4K OSD image data from the storage section 20. When the action mode information indicates that the action mode is the input image mode, the reading section 103 does not read the 4K OSD image data from the storage section 20.

The virtual frame memory 104 is an example of a dividing section that divides OSD image data by n to generate n sets of divided OSD image data. The number n is an integer greater than or equal to two. In the following description, it is assumed that n=4. The virtual frame memory 104 divides the 4K OSD image data read by the reading section 103 by four to generate four sets of divided OSD image data. The number n is not limited to four and only needs to be at least two, as described above. The virtual frame memory 104 outputs position information representing the positions of the divided OSD image data.

Figure 2:
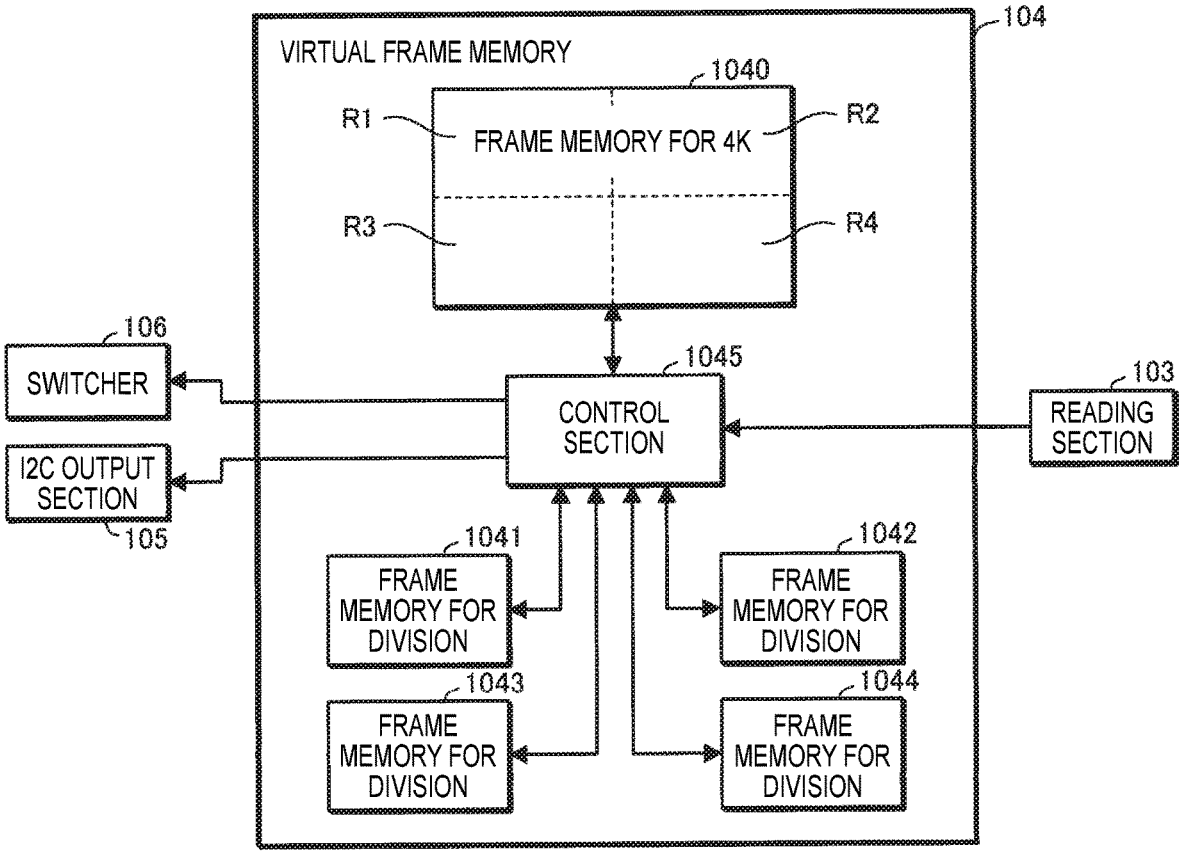
FIG. 2 shows an example of a virtual frame memory.

FIG. 2 shows an example of the virtual frame memory 104.

The virtual frame memory 104 includes a frame memory 1040 for 4K, frame memories 1041 to 1044 for division, and a control section 1045.

The frame memory 1040 for 4K has storage capacity that allows storage of 4K image data. The frame memory 1040 for 4K is divided into four areas, an upper left area R1, an upper right area R2, a lower left area R3, and a lower right area R4. The upper left area R1, the upper right area R2, the lower left area R3, and the lower right area R4 can each store 1080p image data.

The frame memories 1041 to 1044 for division each have storage capacity that allows storage of 1080p image data. The frame memory 1041 for division corresponds to the upper left area R1. The frame memory 1042 for division corresponds to the upper right area R2. The frame memory 1043 for division corresponds to the lower left area R3. The frame memory 1044 for division corresponds to the lower right area R4.

The control section 1045 uses the frame memory 1040 for 4K and the frame memories 1041 to 1044 for division to generate four sets of 1080p OSD image data from 4K OSD image data.

For example, the control section 1045 first writes 4K OSD image data onto the frame memory 1040 for 4K. The control section 1045 may write 4K OSD image produced by the control section 1045 in accordance with a predetermined drawing algorithm onto the frame memory 1040 for 4K in place of the 4K OSD image read by the reading section 103 from the storage section 20.

The control section 1045 subsequently writes a portion of the 4K OSD image data that is the portion written in the upper left area R1 onto the frame memory 1041 for division corresponding to the upper left area R1. The control section 1045 further writes a portion of the 4K OSD image data that is the portion written in the upper right area R2 onto the frame memory 1042 for division, writes a portion of the 4K OSD image data that is the portion written in the lower left area R3 onto the frame memory 1043 for division, and writes a portion of the 4K OSD image data that is the portion written in the lower right area R4 onto the frame memory 1044 for division. The data written onto the frame memories 1041 to 1044 for division are used as divided OSD image data.

The divided OSD image data written onto the frame memory 1041 for division is also referred to as "divided OSD image data (0)." The divided OSD image data written onto the frame memory 1042 for division is also referred to as "divided OSD image data (1)." The divided OSD image data written onto the frame memory 1043 for division is also referred to as "divided OSD image data (2)." The divided OSD image data written onto the frame memory 1044 for division is also referred to as "divided OSD image data (3)."

In the virtual frame memory 104, the frame memory 1040 for 4K may physically differ from the frame memories 1041 to 1044 for division, as shown in FIG. 2, and these memories may instead be formed of a single frame memory that can be switched in time division manner from the frame memory 1040 for 4K to the frame memories 1041 to 1044 for division and vice versa.

The virtual frame memory 104 will be described with reference to a case where the frame memory 1040 for 4K and the frame memories 1041 to 1044 for division are formed of a single frame memory.

For example, in a case where a single frame memory is used as the frame memory 1040 for 4K, the control section 1045 first writes 4K OSD image data onto the frame memory 1040 for 4K. The control section 1045 subsequently sets the position where image data is read from the frame memory 1040 for 4K to be any of the positions of the areas R1 to R4. The setting allows readout of the divided OSD image data (0) to the divided OSD image data (3).

The frame memory 1040 for 4K and the frame memories 1041 to 1044 for division can thus be formed of a single frame memory in the virtual frame memory 104.

In the following description, it is assumed that the frame memory 1040 for 4K and the frame memories 1041 to 1044 for division are formed of a single frame memory in the virtual frame memory 104.

The control section 1045 outputs the divided OSD image data written onto the frame memories 1041 to 1044 for division to the switcher 106. The control section 1045 may instead generate divided OSD image data in accordance with a specific drawing algorithm and output the generated divided OSD image data to the switcher 106.

The control section 1045 further outputs position information representing the position of each of the divided OSD image data (0) to the divided OSD image data (3) to the I2C output section 105.

In the present embodiment, the control section 1045 outputs information representing the position of the upper left area R1 in the frame memory 1040 for 4K (coordinate information) as the position information on the position of the divided OSD image data (0) to the I2C output section 105.

The control section 1045 outputs information representing the position of the upper right area R2 in the frame memory 1040 for 4K (coordinate information) as the position information on the position of the divided OSD image data (1) to the I2C output section 105.

The control section 1045 outputs information representing the position of the lower left area R3 in the frame memory 1040 for 4K (coordinate information) as the position information on the position of the divided OSD image data (2) to the I2C output section 105.

The control section 1045 outputs information representing the position of the lower right area R4 in the frame memory 1040 for 4K (coordinate information) as the position information on the position of the divided OSD image data (3) to the I2C output section 105.

The control section 1045 further outputs a capture start instruction that instructs start of capture of the divided OSD image data to the I2C output section 105.

Upon completion of the output of the four sets of divided OSD image data, the control section 1045 outputs an OSD display instruction to the I2C output section 105. The OSD display instruction is an example of an instruction from the first image processing circuit.

Referring back to FIG. 1, the I2C output section 105 outputs the action mode information, the position information, the capture start instruction, the blackout start instruction, and the OSD display instruction to the image processing circuit 200 via the signal line 400 in accordance with a communication method compliant with the I2C standard.

In the case where the action mode information indicates that the action mode is the OSD mode, the switcher 106 outputs the 1080p divided OSD image data received from the virtual frame memory 104 to the LVDS output section 107.

In the case where the action mode information indicates that the action mode is the input image mode, the switcher 106 outputs the 1080p second input image data acquired by the acquisition section 102 to the LVDS output section 107.

The LVDS output section 107, when it receives the 1080p divided OSD image data from the switcher 106, outputs the 1080p divided OSD image data to the image processing circuit 200 via the signal line 300 in accordance with a communication method compliant with the LVDS standard.

The LVDS output section 107, when it receives the 1080p second input image data from the switcher 106, outputs the 1080p second input image data to the image processing circuit 200 via the signal line 300 in accordance with the communication method compliant with the LVDS standard.

The image processing circuit 200 will next be described.

The image processing circuit 200 includes an LVDS input section 201, an I2C input section 202, a mode management section 203, a switcher 204, a write control section 205, an OSD frame memory 206, a conversion section 207, a superimposing section 208, an acquisition section 209, and a control section 212.

The LVDS input section 201 alternatively receives the 1080p divided OSD image data or the 1080p second input image data via the signal line 300 in accordance with the communication method compliant with the LVDS standard.

The I2C input section 202 receives the action mode information, the blackout start instruction, the position information, the capture start instruction, and the OSD display instruction in accordance with a communication method compliant with the I2C standard via the signal line 400. The I2C input section 202 outputs the action mode information, the blackout start instruction, the position information, and the capture start instruction to the control section 212.

The control section 212 outputs the action mode information to the mode management section 203, outputs the position information and the capture start instruction to the write control section 205, and outputs the blackout start instruction and the OSD display instruction to the superimposing section 208.

The mode management section 203 determines the action mode in accordance with the action mode information and manages the action mode. The mode management section 203 outputs the action mode information to the switcher 204, the conversion section 207, and the superimposing section 208.

In the case where the action mode information indicates that the action mode is the OSD mode, the switcher 204 outputs the 1080p divided OSD image data received by the LVDS input section 201 to the write control section 205 and outputs the 4K first input image data acquired by the acquisition section 209 from the external apparatus 2 to the conversion section 207.

In the case where the action mode information indicates that the action mode the input image mode, the switcher 204 outputs the 1080p second input image data received by the LVDS input section 201 to the conversion section 207.

Having received the capture start instruction, the write control section 205 writes the 1080p divided OSD image data onto the OSD frame memory 206 based on the position information on the positions of the divided OSD image data.

Figure 3:
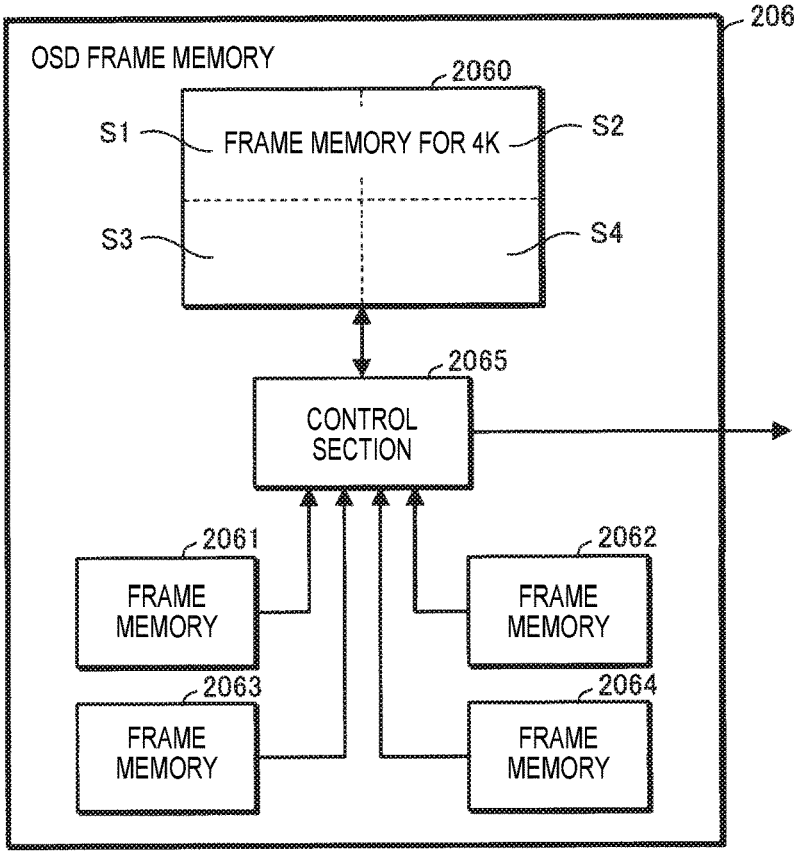
FIG. 3 shows an example of an OSD frame memory.

FIG. 3 shows an example of the OSD frame memory 206.

The OSD frame memory 206 includes a frame memory 2060 for 4K, frame memories 2061 to 2064, and a control section 2065.

The frame memory 2060 for 4K has storage capacity that allows storage of 4K image data. The frame memory 2060 for 4K is divided into four areas, an upper left area S1, an upper right area S2, a lower left area S3, and a lower right area S4. The upper left area S1, the upper right area S2, the lower left area S3, and the lower right area S4 can each store 1080p image data.

Further, the position (coordinates) of the upper left area S1 with respect to the frame memory 2060 for 4K is equal to the position (coordinates) of the upper left area R1 with respect to the frame memory 1040 for 4K.

The position information on the position of the divided OSD image data (0), which represents the position of the upper left area R1 in the frame memory 1040 for 4K, practically shows the position of the upper left area S1 in the frame memory 2060 for 4K.

From the same reason, the position information on the position of the divided OSD image data (1), which represents the position of the upper right area R2 in the frame memory 1040 for 4K, shows the position of the upper right area S2 in the frame memory 2060 for 4K.

The position information on the position of the divided OSD image data (2), which represents the position of the lower left area R3 in the frame memory 1040 for 4K, practically shows the position of the lower left area S3 in the frame memory 2060 for 4K.

The position information on the position of the divided OSD image data (3), which represents the position of the lower right area R4 in the frame memory 1040 for 4K, practically shows the position of the lower right area S4 in the frame memory 2060 for 4K.

The frame memories 2061 to 2064 each have storage capacity that allows storage of 1080p image data. The frame memory 2061 corresponds to the upper left area S1. The frame memory 2062 corresponds to the upper right area S2. The frame memory 2063 corresponds to the lower left area S3. The frame memory 2064 corresponds to the lower right area S4.

The write control section 205 writes the divided OSD image data (0), which is so defined by the position information that the position of the divided OSD image data (0) is equal to the position of the upper left area R1, onto the frame memory 2061 corresponding to the upper left area S1.

The write control section 205 writes the divided OSD image data (1), which is so defined by the position information that the position of the divided OSD image data (1) is equal to the position of the upper right area R2, onto the frame memory 2062 corresponding to the upper right area S2.

The write control section 205 writes the divided OSD image data (2), which is so defined by the position information that the position of the divided OSD image data (2) is equal to the position of the lower left area R3, onto the frame memory 2063 corresponding to the lower left area S3.

The write control section 205 writes the divided OSD image data (3), which is so defined by the position information that the position of the divided OSD image data (3) is equal to the position of the lower right area R4, onto the frame memory 2064 corresponding to the lower right area S4.

The control section 2065 writes the divided OSD image data (0) written onto the frame memory 2061 onto the area S1 of the frame memory 2060 for 4K.

The control section 2065 writes the divided OSD image data (1) written onto the frame memory 2062 onto the area S2 of the frame memory 2060 for 4K.

The control section 2065 writes the divided OSD image data (2) written onto the frame memory 2063 onto the area S3 of the frame memory 2060 for 4K.

The control section 2065 writes the divided OSD image data (3) written onto the frame memory 2064 onto the area S4 of the frame memory 2060 for 4K.

The 4K OSD image data is therefore restored in the frame memory 2060 for 4K.

In the OSD frame memory 206, the frame memories 2061 to 2064 may be omitted.

In this case, the write control section 205 operates as follows.

The write control section 205 writes the divided OSD image data (0), which is so defined by the position information that the position of the divided OSD image data (0) is equal to the position of the upper left area R1, onto the upper left area S1 of the frame memory 2060 for 4K.

The write control section 205 writes the divided OSD image data (1), which is so defined by the position information that the position of the divided OSD image data (1) is equal to the position of the upper right area R2, onto the upper right area S2 of the frame memory 2060 for 4K.

The write control section 205 writes the divided OSD image data (2), which is so defined by the position information that the position of the divided OSD image data (2) is equal to the position of the lower left area R3, onto the lower left area S3 of the frame memory 2060 for 4K.

The write control section 205 writes the divided OSD image data (3), which is so defined by the position information that the position of the divided OSD image data (3) is equal to the position of the lower right area R4, onto the lower right area S4 of the frame memory 2060 for 4K.

In the following description, it is assumed that the frame memories 2061 to 2064 are omitted in the OSD frame memory 206.

The control section 2065 reads the 4K OSD image data from the frame memory 2060 for 4K and outputs the 4K OSD image data to the superimposing section 208.

Referring back to FIG. 1, when the action mode information indicates that the action mode is the OSD mode, the conversion section 207 does not perform the scaling operation on the 4K first input image data received from the switcher 204 but outputs the 4K first input image data to the superimposing section 208.

When the action mode information indicates that the action mode is the input image mode, the conversion section 207 performs the scaling operation of converting the resolution of the 1080p second input image data received from the switcher 204 into 4K to generate output image data and outputs the output image data to the superimposing section 208.

The superimposing section 208, when it receives the blackout start instruction, outputs blackout image data set in advance (solid-black 4K image data) to the projection section 40. The blackout image data is stored in the superimposing section 208.

The superimposing section 208, when it receives the blackout start instruction, may output no image data to the projection section 40 instead of outputting the blackout image data to the projection section 40 to achieve the blackout.

The superimposing section 208, when it receives the OSD display instruction in the situation in which the action mode information indicates that the action mode is the OSD mode, uses the 4K OSD image data received from the OSD frame memory 206 and the 4K first input image data received from the conversion section 207 to generate 4K combined image data and outputs the 4K combined image data to the projection section 40.

The superimposing section 208, when it receives 4K output image data in the situation in which the action mode information indicates that the action mode is the input image mode, outputs the 4K output image data to the projection section 40.

In the following description, the 4K blackout image data, the 4K combined image data, and the 4K output image data outputted by the superimposing section 208 are also collectively referred to as "4K image data outputted by the superimposing section 208."

The projection section 40 projects and displays an image according to the 4K image data outputted by the superimposing section 208 on a display surface 4. The projection section 40 is an example of a display section. The projection surface 4 is an example of a display surface.

Figure 4:
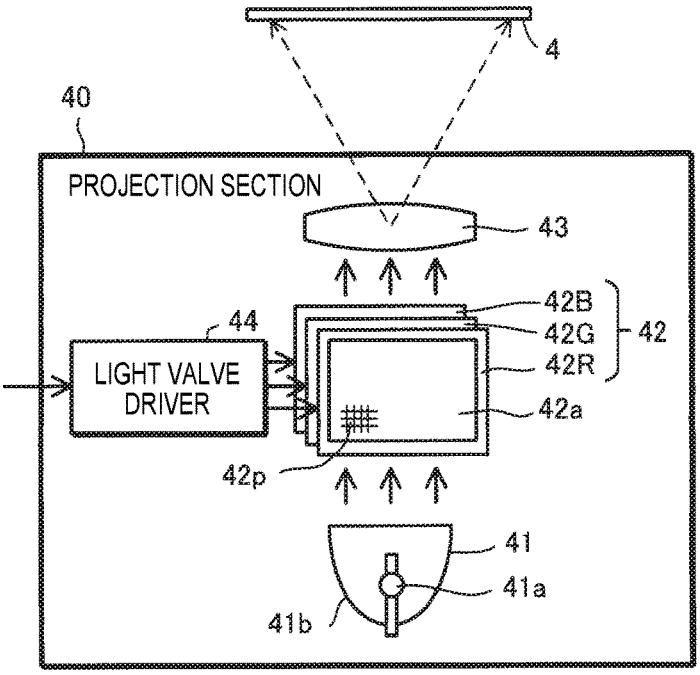
FIG. 4 shows an example of a projection section.

FIG. 4 shows an example of the projection section 40. The projection section 40 includes a light source 41, three liquid crystal light valves 42 (42R, 42G, and 42B), which are each an example of a light modulator, a projection lens 43, which is an example of a projection system, a light valve driver 44, and other components. In the projection section 40, the liquid crystal light valves 42 modulate light emitted from the light source 41 to form a projection image (image light), and the projection lens 43 enlarges and projects the projection image.

The light source 41 includes a light source section 41*a*, which is formed, for example, of a xenon lamp, an ultrahigh-pressure mercury lamp, a light emitting diode (LED), or a laser light source, and a reflector 41*b*, which reduces variation in the direction of the light radiated by the light source section 41*a*. The light emitted from the light source 41 passes through an optical integration system that is not shown, which reduces variation in the luminance distribution of the light, and the resultant light is then separated by a color separation system that is not shown into red (R), green (G), and blue (B) light components, which are the three primary colors of light. The R, G, and B light components are incident on the liquid crystal light valves 42R, 42G, and 42B, respectively.

The liquid crystal light valves 42 are each formed, for example, of a liquid crystal panel in which a liquid crystal material is encapsulated between a pair of transparent substrates. The liquid crystal light valves 42 each have a rectangular pixel area 42*a* formed of a plurality of pixels 42*p* arranged in a matrix. In each of the liquid crystal light valves 42, drive voltage is applicable to the liquid crystal material for each of the pixels 42*p*. When the light valve driver 44 applies drive voltage according to the 4K image data inputted from the superimposing section 208 to each of the pixels 42*p*, the optical transmittance of the pixel 42*p* is set at a value according to the image data. The light emitted from the light source 41 is therefore modulated when passing through each of the pixel areas 42*a* to form an image according to the image data on a color basis.

The color images are combined with one another by a light combining system that is not shown on a pixel basis or for each of the pixels 42*p* into projection image light (projection image) that is color image light (color image). The projection image light is enlarged and projected by the projection lens 43 onto the projection surface 4.

The action of the projector 1 will next be described.

Figure 5:
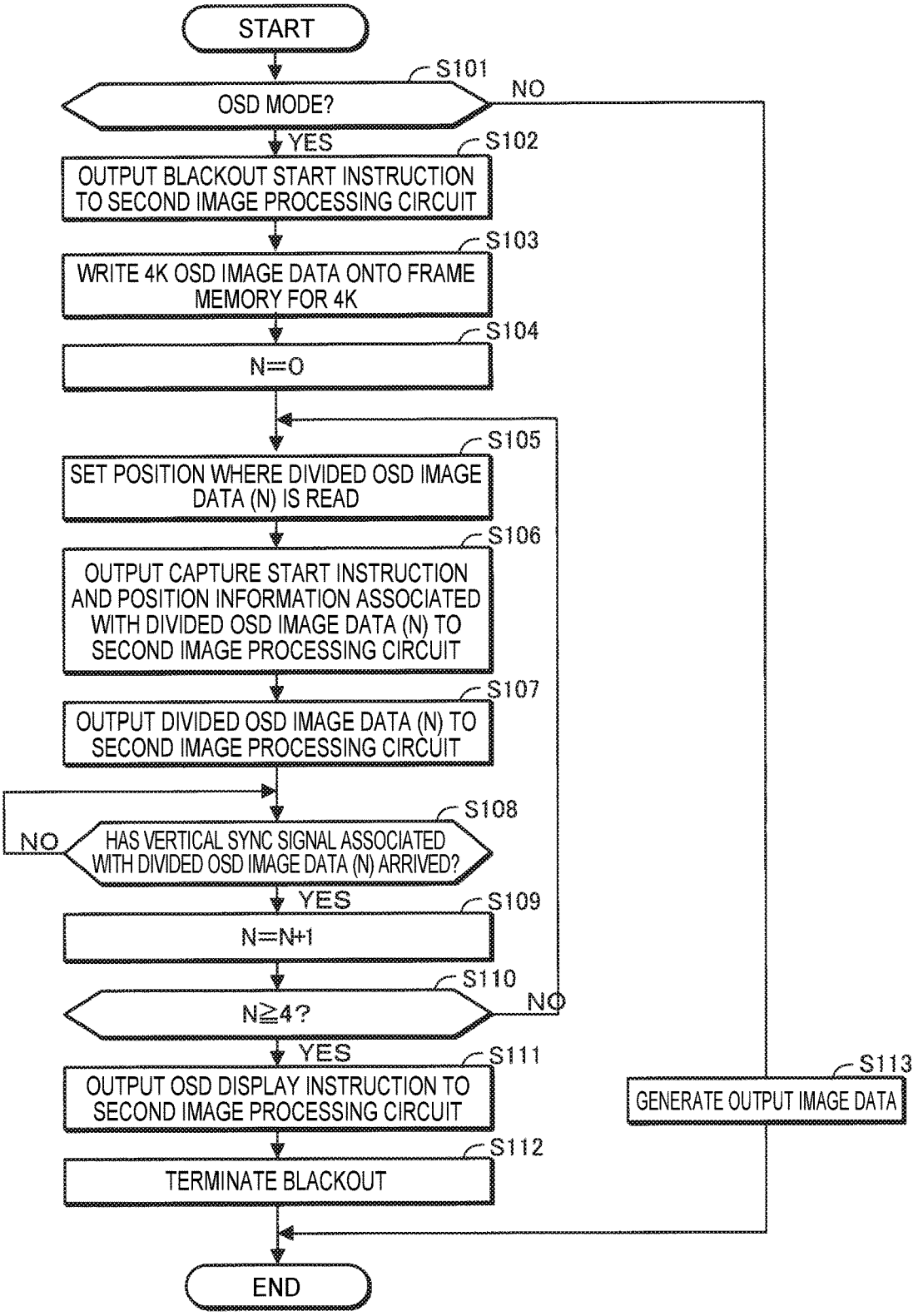
FIG. 5 is a flowchart for describing the action of the projector.

FIG. 5 is a flowchart for describing the action of the projector 1.

The control section 101 switches the action mode to the OSD mode in accordance with the user's input operation performed on the operation section 10 (YES in step S101) and outputs the blackout start instruction to the I2C output section 105. The I2C output section 105 outputs the blackout start instruction received from the control section 101 to the image processing circuit 200 via the signal line 400 (step S102).

In the image processing circuit 200, the I2C input section 202 outputs the blackout start instruction received from the image processing circuit 100 to the control section 212. The control section 212 outputs the blackout start instruction received from the I2C input section 202 to the superimposing section 208. Having received the blackout start instruction, the superimposing section 208 outputs the blackout image data to the projection section 40 to cause the projection section 40 to project a solid-black image to start the blackout. The image processing apparatus 30 generates combined image data, as will be described later, in the period for which the projection section 40 projects the solid-black image.

The control section 101 subsequently notifies the I2C output section 105, the reading section 103, and the switcher 106 of the action mode information indicating that the action mode is the OSD mode.

The I2C output section 105 outputs the action mode information received from the control section 101 to the image processing circuit 200 via the signal line 400.

In the image processing circuit 200, the I2C input section 202 outputs the action mode information received from the image processing circuit 100 to the control section 212. The control section 212 outputs the action mode information received from the I2C input section 202 to the mode management section 203. The mode management section 203 outputs the action mode information received from the control section 212 to the switcher 204, the conversion section 207, and the superimposing section 208.

In the image processing circuit 100, the reading section 103, when it receives the action mode information indicating that the action mode is the OSD mode, reads the 4K OSD image data from the storage section 20 and outputs the 4K OSD image data to the virtual frame memory 104.

In the virtual frame memory 104, the control section 1045 writes the 4K OSD image data received from the reading section 103 onto the frame memory 1040 for 4K (step S103).

The control section 1045 subsequently sets a variable N held by the control section 1045 at "0" (step S104). The variable N corresponds to any of the numerals in the parentheses described above with which the divided OSD image data are labeled.

The control section 1045 subsequently sets the position where image data is read from the frame memory 1040 for 4K to be the position (coordinates) where the divided image data (N) has been written (step S105).

The control section 1045 subsequently outputs the capture start instruction and the position information associated with the divided OSD image data (N) to the I2C output section 105. The I2C output section 105 outputs the capture start instruction and the position information associated with the divided OSD image data (N) to the image processing circuit 200 via the signal line 400 (step S106).

In the image processing circuit 200, the I2C input section 202 outputs the capture start instruction and the position information associated with the divided OSD image data (N) and received from the image processing circuit 100 to the control section 212. The control section 212 outputs the capture start instruction and the position information associated with the divided OSD image data (N) and received from the image processing circuit 100 to the write control section 205.

The control section 1045 subsequently reads the divided OSD image data (N) based on the readout position (coordinates) in the frame memory 1040 for 4K set in step S105 and outputs the divided OSD image data (N) to the switcher 106.

Since the action mode information received from the control section 101 indicates that the action mode is the OSD mode, the switcher 106 outputs the divided OSD image data (N) received from the virtual frame memory 104 to the LVDS output section 107. The LVDS output section 107 outputs the divided OSD image data (N) received from the switcher 106 to the image processing circuit 200 via the signal line 300 (step S107).

In the image processing circuit 200, the LVDS input section 201, when it receives the divided OSD image data (N), outputs the divided OSD image data (N) to the switcher 204.

Since the action mode information received from the mode management section 203 indicates that the action mode is the OSD mode, the switcher 204 outputs the divided OSD image data (N) received from the LVDS input section 201 to the write control section 205.

The write control section 205, which has already received the capture start instruction and the position information associated with the divided OSD image data (N), writes the divided OSD image data (N) received from the switcher 204 onto one of the four areas S1 to S4 of the frame memory 2060 for 4K that is the area according to the position information.

The control section 1045 in the image processing circuit 100 subsequently waits for the vertical sync signal that means the end of the divided OSD image data (N) (NO in step S108). That is, the control section 1045 waits until the entire divided OSD image data (N) is read.

When the vertical sync signal that means the end of the divided OSD image data (N) arrives (YES in step S108), the control section 1045 substitutes N+1 into the variable N (step S109).

Subsequently, when the variable N is smaller than four (NO in step S110), the control section 1045 returns to the process in step S105.

In the image processing circuit 200, since the action mode information received from the mode management section 203 indicates that the action mode is the OSD mode, the switcher 204 acquires the 4K first input image data from the external apparatus 2 via the acquisition section 209 and outputs the first input image data to the conversion section 207.

Since the action mode information received from the mode management section 203 indicates that the action mode is the OSD mode, the conversion section 207 does not perform the scaling operation on the 4K first input image data received from the switcher 204 but outputs the first input image data to the superimposing section 208.

When the variable N is greater than or equal to four (YES in step S110), that is, when the 4K OSD image data is restored in the frame memory 2060 for 4K, the control section 1045 outputs the OSD display instruction to the I2C output section 105. The I2C output section 105 outputs the OSD display instruction received from the control section 1045 to the image processing circuit 200 via the signal line 400 (step S111).

In the image processing circuit 200, the I2C input section 202 outputs the OSD display instruction received from the image processing circuit 100 to the control section 212. The control section 212 outputs the OSD display instruction received from the I2C input section 202 to the superimposing section 208.

Having received the OSD display instruction, the superimposing section 208 notifies the control section 2065 of the OSD frame memory 206 of an OSD image data request to request OSD image data. The control section 2065 reads the 4K OSD image data from the frame memory 2060 for 4K in response to the OSD image data request and outputs the 4K OSD image data to the superimposing section 208.

The superimposing section 208 subsequently uses the 4K OSD image data and the 4K first input image data received from the conversion section 207 to generate combined image data. The superimposing section 208 subsequently stop outputting the blackout image data to terminate the blackout and then outputs the combined image data to the projection section 40 to cause the projection section 40 to project the combined image on the projection surface 4 (step S112).

On the other hand, when the action mode is switched to the input image mode (NO in step S101), in the image processing circuit 100, the control section 101 notifies the reading section 103, the I2C output section 105, and the switcher 106 of the action mode information indicating that the action mode is the input image mode.

The I2C output section 105 outputs the action mode information received from the control section 101 to the image processing circuit 200 via the signal line 400.

In the image processing circuit 200, the I2C input section 202 outputs the action mode information received from the image processing circuit 100 to the control section 212. The control section 212 outputs the action mode information received from the I2C input section 202 to the mode management section 203. The mode management section 203 outputs the action mode information received from the control section 212 to the switcher 204, the conversion section 207, and the superimposing section 208.

In the image processing circuit 100, the reading section 103, when it receives the action mode information indicating that the action mode is the input image mode, stops reading the 4K OSD image data from the storage section 20. Therefore, the reading section 103 stops outputting 4K OSD image data to the virtual frame memory 104, and the virtual frame memory 104 also stops outputting image data.

Since the action mode information indicates that the action mode is the input image mode, the switcher 106 outputs the 1080p second input image data acquired by the acquisition section 102 from the external apparatus 3 to the image processing circuit 200 via the LVDS output section 107 and the signal line 300.

In the image processing circuit 200, since the action mode information indicates that the action mode is the input image mode, the switcher 204 outputs the second input image data received via the signal line 300 and the LVDS input section 201 to the conversion section 207. Since the action mode information indicates that the action mode is the input image mode, the conversion section 207 performs the scaling operation on the second input image data to generate 4K output image data (step S113). The image processing circuit 200 outputs the 4K output image data to the projection section 40 to cause the projection section 40 to project the second input image on the projection surface 4.

According to the image processing apparatus 30 and the image processing method according to the present embodiment, when OSD image data is provided, divided OSD image data having resolution lower than that of the OSD image data are outputted from the image processing circuit 100 to the image processing circuit 200. The period required to transmit data according to the OSD image from the image processing circuit 100 to the image processing circuit 200 can therefore be shortened, as compared with a configuration in which the OSD image data is outputted from the image processing circuit 100 to the image processing circuit 200. The period required to output combined image data can therefore be shortened.

For example, in 4K image data communication, a long period is required for the communication due to insufficient communication band. In the 1080p image data communication, however, use of a signal line (communication method) having sufficient communication band can shorten the period required for the image data communication.

Further, according to the aspect described above, a communication method incapable of 4K image data communication due, for example, to an insufficient communication band can be used to practically transmit OSD image data.

Second Embodiment

The first embodiment has been described with reference to the case where OSD image data has the resolution of 4K. A second embodiment will be described with reference to a case where OSD image data does not necessarily have the resolution of 4K. In the second embodiment, in a case where OSD image data has a resolution lower than 4K, the OSD image data is not divided but is, for example, compressed, and the compressed OSD image data is outputted, whereas in a case where OSD image data has a resolution higher than or equal to 4K, the OSD image data is divided and the divided imaged data are outputted. The image processing circuit 200 outputs combined image data based, for example, on the compressed OSD image data and the first input image data.

Figure 6:
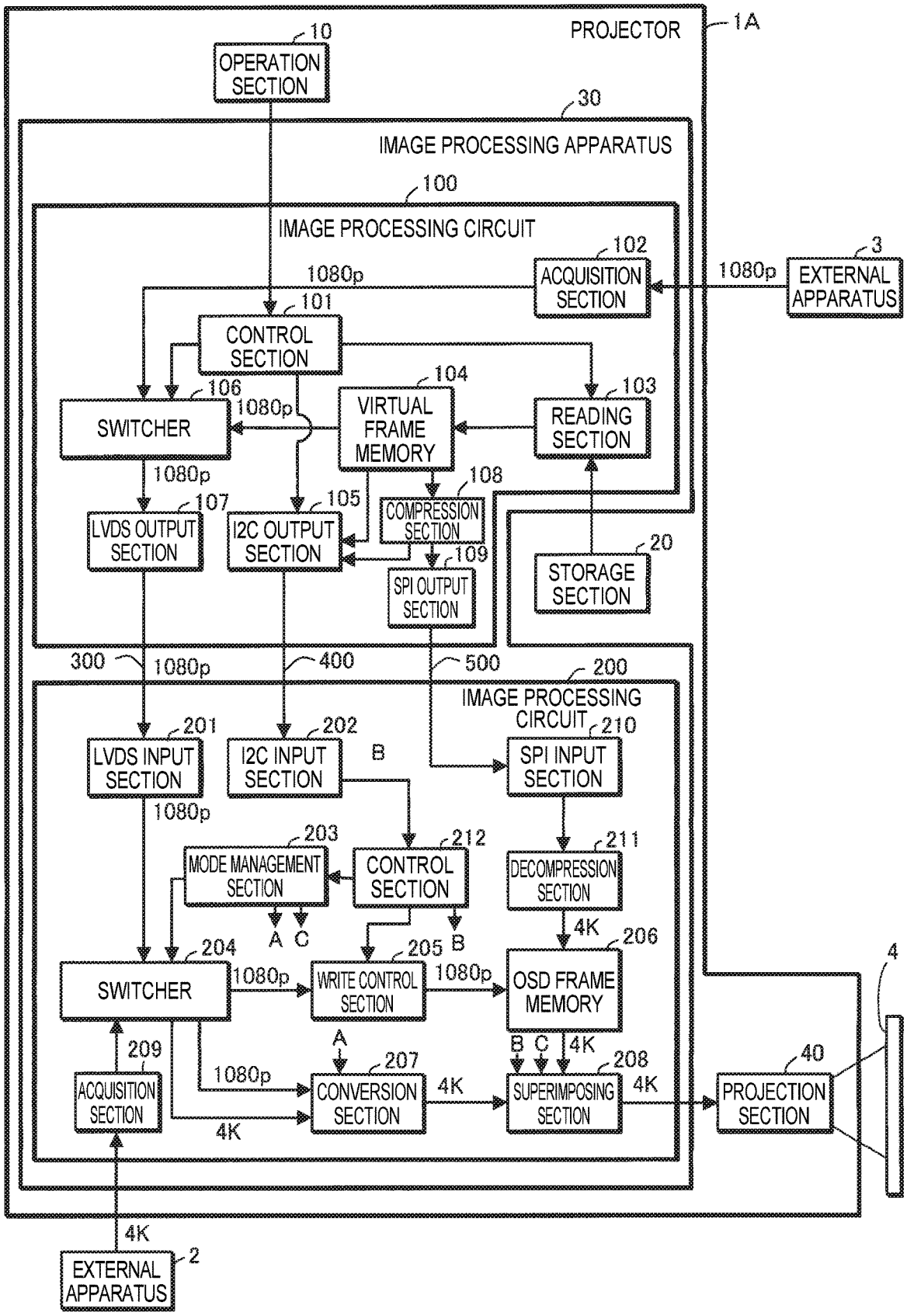
FIG. 6 shows a projector according to a second embodiment.

FIG. 6 shows a projector 1A according to the second embodiment. In FIG. 6, the same configurations as those shown in FIG. 1 have the same reference characters.

The projector LA differs from the projector 1 according to the first embodiment in that the image processing circuit 100 further includes a compression section 108 and a serial peripheral interface (SPI) output section 109, that the image processing circuit 20 further includes an SPI input section 210 and a decompression section 211, that the image processing apparatus 30 further includes a signal line 500, and that the virtual frame memory 104 and the OSD frame memory 206 each have a further function. The following description will be primarily made of the points of the projector 1A that differ from those of the projector 1.

In the case where OSD image data read by the readier section 103 has resolution higher than or equal to 4K, the control section 1045 of the virtual frame memory 104 performs the same action as that in the first embodiment. On the other hand, in the case where OSD image data read by the readier section 103 has resolution lower than 4K, the control section 1045 outputs the OSD image data to the compression section 108. The value of 4K is an example of a threshold.

The compression section 108 has a compression function. In a case where the OSD image data received from the virtual frame memory 104 satisfies a compression condition set in advance, the compression section 108 compresses the OSD image data to generate compressed OSD image data. An example of the compression condition may include a condition that "10 or more successive bytes have the same data." The compression condition is not limited to the condition that "10 or more successive bytes have the same data" and can be changed as appropriate.

Having generated the compressed OSD image data, the compression section 108 outputs the capture start instruction, the compression/uncompression information representing that OSD image data has been compressed, and the compressed OSD image data to the SPI output section 109.

On the other hand, in a case where the OSD image data received from the virtual frame memory 104 does not satisfy the compression condition, the compression section 108 does not compress the OSD image data. In this case, the compression section 108 outputs the capture start instruction, the compression/uncompression information representing that OSD image data has not been compressed, and the OSD image data to the SPI output section 109.

The SPI output section 109 outputs the capture start instruction, the compression/uncompression information, and the compressed OSD image data from the compression section 108 to the image processing circuit 200 via the signal line 500 in accordance with a communication method compliant with the SPI standard. The signal line 500 is an example of a third signal line.

The SPI output section 109 alternatively outputs the capture start instruction, the compression/uncompression information, and the OSD image data received from the compression section 108 to the image processing circuit 200 via the signal line 500 in accordance with the communication method compliant with the SPI standard.

The SPI input section 210 outputs the capture start instruction, the compression/uncompression information, and the compressed OSD image data or the OSD image data received from the SPI output section 109 via the signal line 500 in accordance with the communication method compliant with the SPI standard to the decompression section 211.

The decompression section 211 has a decompression function and a scaling function. In a case where the compression/uncompression information received from the SPI input section 210 indicates that the OSD image data has been compressed, the decompression section 211 decompresses the compressed OSD image data received from the SPI input section 210 to restore the OSD image data. The restored OSD image data is an example of decompressed OSD image data. The decompression section 211 subsequently performs scaling operation of converting the resolution of the restored OSD image data into 4K.

In a case where the compression/uncompression information received from the SPI input section 210 indicates that the OSD image data has not been compressed, the decompression section 211 performs the scaling operation of converting the resolution of the OSD image data received from the SPI input section 210 into 4K.

The decompression section 211 outputs the capture start instruction and the 4K OSD image data to the OSD frame memory 206.

Having received the capture start instruction and the 4K OSD image data, the OSD frame memory 206 writes the 4K OSD image data onto the frame memory 2060 for 4K of the OSD frame memory 206.

Figure 7:
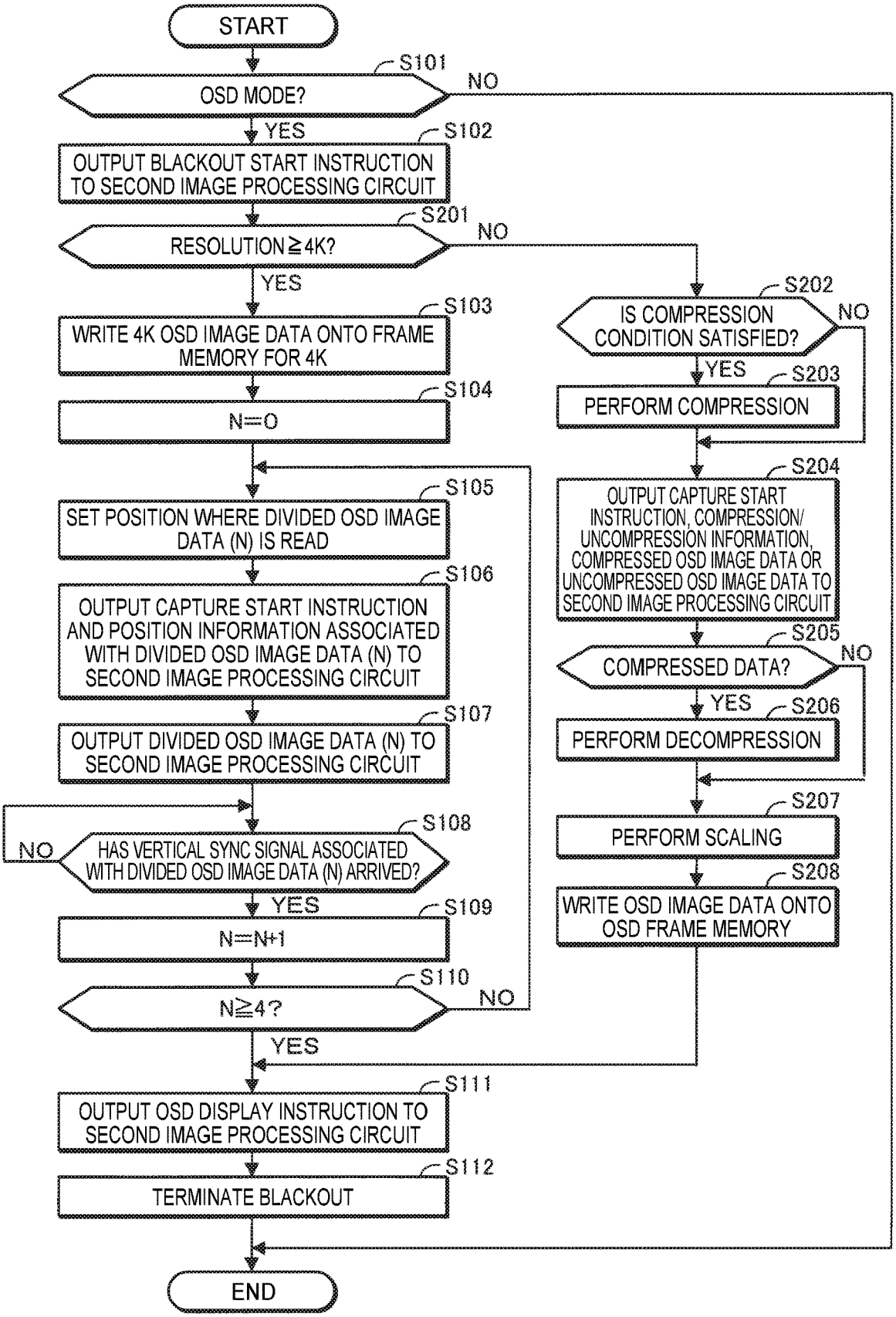
FIG. 7 is a flowchart for describing the action of the projector according to the second embodiment.

FIG. 7 is a flowchart for describing the action of the projector 1A. In FIG. 7, the same processes as those shown in FIG. 5 have the same reference characters. The following description will be primarily made of processes shown in FIG. 7 that differ from those shown in FIG. 5.

In the OSD mode, the control section 1045 of the virtual frame memory 104 carries out step S103 when the OSD image data read by the reading section 103 from the storage section 20 has the resolution higher than or equal to 4K (YES in step S201).

On the other hand, when the OSD image data read by the reading section 103 from the storage section 20 has the resolution smaller than 4K (NO in step S201), the control section 1045 outputs the OSD image data to the compression section 108.

In the case where the OSD image data received from the control section 1045 satisfies the compression condition (YES in step S202), the compression section 108 compresses the OSD image data to generate compressed OSD image data (step S203). The compression section 108 subsequently outputs the capture start instruction, the compression/uncompression information representing that OSD image data has been compressed, and the compressed OSD image data to the SPI output section 109.

The SPI output section 109 outputs the capture start instruction, the compression/uncompression information representing that OSD image data has been compressed, and the compressed OSD image data received from the compression section 108 to the image processing circuit 200 via the signal line 500 (step S204).

In the image processing circuit 200, the SPI input section 210, when it receives the capture start instruction, the compression/uncompression information representing that OSD image data has been compressed, and the compressed OSD image data via the signal line 500, outputs the received information to the decompression section 211.

Having received the capture start instruction, the compression/uncompression information representing that OSD image data has been compressed, and the compressed OSD image data, the decompression section 211 decompresses the compressed OSD image data to restore the OSD image data (step S206) because the compression/uncompression information indicates that the OSD image data has been compressed (YES in step S205).

The decompression section 211 subsequently performs the scaling operation of converting the resolution of the restored OSD image data to 4K (step S207). The decompression section 211 subsequently outputs the OSD image data having the resolution converted into 4K and the capture start instruction to the OSD frame memory 206.

When the OSD frame memory 206 receives the 4K OSD image data and the capture start instruction, the control section 2065 writes the 4K OSD image data onto the frame memory 2060 for 4K (step S208).

On the other hand, having outputted the capture start instruction, the compression/uncompression information representing that the OSD image data has been compressed, and the compressed OSD image data to the SPI output section 109, the compression section 108 outputs the OSD display instruction to the I2C output section 105. The I2C output section 105 outputs the OSD display instruction received from the compression section 108 to the image processing circuit 200 via the signal line 400 (step S111).

In a case where the compression condition is not satisfied in step S202 (NO in step S202), the compression section 108 outputs the capture start instruction, the compression/uncompression information representing that the OSD image data has not been compressed, and the OSD image data to the SPI output section 109.

The SPI output section 109 outputs the capture start instruction, the compression/uncompression information representing that OSD image data has not been compressed, and the OSD image data received from the compression section 108 to the image processing circuit 200 via the signal line 500 (step S204).

In the image processing circuit 200, the SPI input section 210, when it receives the capture start instruction, the compression/uncompression information representing that OSD image data has not been compressed, and the OSD image data via the signal line 500, outputs the received information to the decompression section 211.

Having received the capture start instruction, the compression/uncompression information representing that OSD image data has not been compressed, and the OSD image data, the archiving section 211 skips step S206 and carries out step S207 because the compression/uncompression information indicated that the OSD image data has not been compressed (NO in step S205) and carries out step S207.

According to the present embodiment, divided OSD image data can be transmitted, for example, only in the case where it takes time to transmit OSD image data from the image processing circuit 100 to the image processing circuit 200 because the OSD image data has the resolution higher than or equal to the threshold, such as 4K.

In the case where the resolution of OSD image data is lower than the threshold, compressed OSD image data is, for example, outputted from the image processing circuit 100 to the image processing circuit 200. Therefore, in the case where the resolution of OSD image data is lower than the threshold, such as 4K, the period required to transmit data according to the OSD image from the image processing circuit 100 to the image processing circuit 200 can therefore be always shortened as compared with a configuration in which the OSD image data is outputted from the image processing circuit 100 to the image processing circuit 200. The present embodiment can therefore shorten the period required to output combined image data.

In the present embodiment, in the case where the resolution of OSD image data is lower than the threshold and the OSD image data satisfies the compression condition, compressed OSD image data can be outputted from the image processing circuit 100 to the image processing circuit 200. Therefore, in a situation in which there is OSD image data that is hardly compressed even when compression is performed thereon, setting the compression condition as appropriate can prevent hardly-effective compression to be performed on the OSD image data.

Variations

The invention is not limited to the embodiments described above, and a variety of variations, for example, those that will be described below, are conceivable. Further, one or more variations arbitrarily selected from the following aspects of variations can be combined with one another as appropriate.

Variation 1

The OSD frame memory 206 may be provided with two frame memories for 4K, with one of the frame memories for 4K used for foreground and the other frame memory for 4K used for background.

In this case, while an image according to 4K image data written onto the foreground frame memory for 4K is projected, the background frame memory for 4K is used to generate combined image data, and when the generation of the combined image data is completed, the background frame memory for 4K and the foreground frame memory for 4K may be swapped. Specifically, when combined image data is generated in the background frame memory for 4K, the background frame memory for 4K is switched to the foreground frame memory for 4K, and the foreground frame memory for 4K is switched to the background frame memory for 4K.

According to Variation 1, while the combined image data is generated, the events that occur in the generation of the combined image are not displayed but a proper image is displayed. The blackout operation can therefore be omitted.

Variation 2

In the first embodiment, the resolution of OSD image data, the resolution of first input image data, and the resolution of combined image data are not each limited to 4K and may, for example, be higher than 4K and can be changed as appropriate.

In the second embodiment, the resolution of first input image data and the resolution of combined image data are not each limited to 4K and may, for example, be higher than 4K and can be changed as appropriate.

Variation 3

In the first and second embodiments, the image processing apparatus 30 acquires first input image data and second input image data via a general-purpose interface, for example, an HDMI (registered trademark) interface. The interface used to acquire first input image data and the interface used to acquire second input image data may differ in type from each other or may be of the same type.

Variation 4

The communication method using the signal line 300 is not limited to the communication method compliant with the LVDS standard and can be changed as appropriate. The communication method using the signal line 400 is not limited to the communication method compliant with the I2C standard and can be changed as appropriate. The communication method using the signal line 500 is not limited to the communication method compliant with the SPI standard and can be changed as appropriate.

Variation 5

The image processing circuits 100 and 200 may each include a processing section formed of a computer, such as one or more CPUs (central processing units), and a storage section that stores a program that defines the action of the computer.

Figure 8:
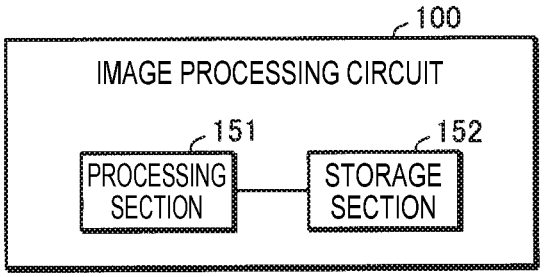
FIG. 8 shows an example of an image processing circuit.

FIG. 8 shows an example of the image processing circuit 100 including a processing section 151, which is formed of a computer, such as one or more CPUs, and a computer readable storage section 152.

The processing section 151 reads and executes the program stored in the storage section 152 to achieve the control section 101, the acquisition section 102, the reading section 103, the control section 1045, the I2C output section 105, the switcher 106, the LVDS output section 107, the compression section 108, and the SPI output section 109.

Also in the image processing circuit 200, the processing section reads and executes the program stored in the storage section to achieve the LVDS input section 201, the I2C input section 202, the mode management section 203, the switcher 204, the write control section 205, the control section 2065, the conversion section 207, the superimposing section 208, and the acquisition section 209.

Variation 6

The entirety or part of the elements of the image processing circuits 100 and 200 may be achieved by hardware formed, for example, of an FPGA (field programmable gate array), an ASIC (application specific IC), or any other electronic circuit or may be achieved by software and hardware that cooperate with each other.

Variation 7

The liquid crystal light valves 42 are used as the light modulator, and the light modulator may not be formed of the liquid crystal light valves 42 and can be changed as appropriate. For example, the light modulator may instead be configured to use three reflective liquid crystal panels. The light modulator may still instead, for example, be configured to use one liquid crystal panel, three digital mirror devices (DMDs), or one digital mirror device. In the case where only one liquid crystal panel or DMD is used as the light modulator, no members corresponding to the color separation system and the light combining system are required. Further, a configuration including no liquid crystal panel or DMD but capable of modulating the light emitted from the light source 41 can be employed as the light modulator.

Variation 8

A projector is used as the display apparatus, but the display apparatus is not limited to a projector and can be changed as appropriate. For example, the display apparatus may be a direct-view display. In this case, the projection section 40 is replaced, for example, with a liquid crystal display or any other direct-view display section.

What is claimed is:

1. An image processing apparatus comprising:

a first image processing circuit; and a second image processing circuit connected to the first image processing circuit via a first signal line and a second signal line, wherein the first image processing circuit is configured to:

when an action mode is a first mode, output a plurality of divided On-Screen-Display (OSD) image data to the second image processing circuit via the first signal line, the plurality of divided OSD image data having been generated by dividing OSD image data representing an OSD image, when the action mode is a second mode, output second input image data representing a second input image to the second image processing circuit via the first signal line, and output position information representing positions of the plurality of divided OSD image data to the second image processing circuit via the second signal line, and the second image processing circuit is configured to:

when the action mode is the first mode, output combined image data representing a combined image formed a first input image on which the OSD image is superimposed, based on first input image data representing the first input image, the plurality of divided OSD image data, and the position information, and when the action mode is the second mode, convert a resolution of the second input image data and output resultant second input image data as output image data.

2. The image processing apparatus according to claim 1, wherein the first image processing circuit is configured to divide the OSD image data by n to generate the n sets of divided OSD image data.

3. A display apparatus comprising:

the image processing apparatus according to claim 2; and a light source and light modulator configured to display an image on a display surface according to the combined image data outputted by the image processing apparatus.

4. The image processing apparatus according to claim 1, wherein the first image processing circuit is configured to output action mode information representing the action mode to the second image processing circuit via the second signal line, and the second image processing circuit is configured to determine the action mode based on the action mode information.

5. A display apparatus comprising:

the image processing apparatus according to claim 4; and a light source and light modulator configured to display an image on a display surface according to the combined image data outputted by the image processing apparatus.

6. The image processing apparatus according to claim 1, wherein the second image processing circuit includes a frame memory, the position information represents the positions of the divided OSD image data in the frame memory, and the second image processing circuit is configured to write the divided OSD image data based on the position information onto the frame memory to generate the OSD image data.

7. A display apparatus comprising:

the image processing apparatus according to claim 6; and a light source and light modulator configured to display an image on a display surface according to the combined image data outputted by the image processing apparatus.

8. The image processing apparatus according to claim 1, wherein the second image processing circuit is configured to output the combined image data according to an instruction from the first image processing circuit.

9. A display apparatus comprising:

the image processing apparatus according to claim 8; and a light source and light modulator configured to display an image on a display surface according to the combined image data outputted by the image processing apparatus.

10. The image processing apparatus according to claim 1, wherein in a case where resolution of the OSD image data is higher than or equal to a threshold, the first image processing circuit is configured to output the divided OSD image data to the second image processing circuit.

11. The image processing apparatus according to claim 10, wherein in a case where the resolution of the OSD image data is lower than the threshold, the first image processing circuit is configured to compress the OSD image data to generate compressed OSD image data and output the compressed OSD image data to the second image processing circuit via a third signal line, and the second image processing circuit is configured to decompress the compressed OSD image data to generate decompressed OSD image data and output the combined image data based on the decompressed OSD image data and the input image data.

12. The image processing apparatus according to claim 11, wherein in a case where the resolution of the OSD image data is lower than the threshold and the OSD image data satisfies a compression condition set in advance, the first image processing circuit is configured to generate the compressed OSD image data and output the compressed OSD image data to the second image processing circuit via the third signal line.

13. A display apparatus comprising:

the image processing apparatus according to claim 12; and a light source and light modulator configured to display an image on a display surface according to the combined image data outputted by the image processing apparatus.

14. A display apparatus comprising:

the image processing apparatus according to claim 10; and a light source and light modulator configured to display an image on a display surface according to the combined image data outputted by the image processing apparatus.

15. A display apparatus comprising:

the image processing apparatus according to claim 11; and a light source and light modulator configured to display an image on a display surface according to the combined image data outputted by the image processing apparatus.

16. A display apparatus comprising:

the image processing apparatus according to claim 1; and a light source and light modulator configured to display an image on a display surface according to the combined image data outputted by the image processing apparatus.

17. An image processing method comprising:

when an action mode is a first mode, causing a first image processing circuit to output a plurality of divided On-Screen-Display (OSD) image data to a second image processing circuit via a first signal line, the plurality of divided OSD image data having been generated by dividing OSD image data representing an OSD image;

when the action mode is a second mode, causing the first image processing circuit to output second input image data representing a second input image to the second image processing circuit via the first signal line;

causing the first image processing circuit to output position information representing positions of the plurality of divided OSD image data to the second image processing circuit via a second signal line;

when the action mode is the first mode, causing the second image processing circuit to output combined image data representing a combined image formed of a first input image on which the OSD image is superimposed, based on first input image data representing the first input image, the plurality of divided OSD image data, and the position information; and when the action mode is the second mode, causing the second image processing circuit to convert a resolution of the second input image data and output resultant second input image data as output image data.

18. An image processing apparatus comprising:

a first image processing circuit; and a second image processing circuit connected to the first image processing circuit via a first signal line and a second signal line, wherein the first image processing circuit is configured to:

in a case where a resolution of On-Screen-Display (OSD) image data representing an OSD image is higher than or equal to a threshold, output a plurality of divided OSD image data to the second image processing circuit via the first signal line, the plurality of divided OSD image data having been generated by dividing the OSD image data, and output position information representing positions of the plurality of divided OSD image data to the second image processing circuit via the second signal line, and the second image processing circuit is configured to output combined image data representing a combined image formed of a first input image on which the OSD image is superimposed, based on first input image data representing the first input image, the plurality of divided OSD image data, and the position information.

* * * * *